US005177950A

United States Patent [19]

Fowler, Jr. et al.

[11] Patent Number: 5,177,950

[45] Date of Patent: Jan. 12, 1993

[54] FLEXIBLE WHIRL-CLEANING NOZZLE

[76] Inventors: Floyd N. Fowler, Jr., 4533 Arborway, Charlotte, N.C. 28211; Charles T. Sumner, 221 Post Oak Rd., Charlotte, N.C. 28211

[21] Appl. No.: 623,011

[22] Filed: Dec. 6, 1990

[51] Int. Cl.[5] ..... D01H 11/00

[52] U.S. Cl. ..... 57/304; 15/312.2; 28/295; 239/602

[58] Field of Search ..... 57/300, 301, 304, 305, 57/306, 307; 28/294, 295; 15/312.2; 239/533.13, 602

[56] References Cited

U.S. PATENT DOCUMENTS

| | | | |
|---|---|---|---|
| 2,524,797 | 10/1950 | Holtzclaw | 57/304 X |
| 2,846,752 | 8/1958 | Lessig | 427/175 |
| 3,003,177 | 10/1961 | Hijiya | 239/602 X |
| 3,305,184 | 2/1967 | Seress et al. | 242/35.5 R |
| 3,429,745 | 2/1969 | Black, Jr. | 15/312.1 X |
| 3,523,413 | 8/1970 | Ford et al. | 57/265 |
| 4,058,963 | 11/1977 | Stahlecker | 57/304 X |
| 4,484,434 | 11/1984 | Rümmele | 57/304 |
| 4,485,616 | 12/1984 | Morita et al. | 242/35.5 X |
| 4,594,845 | 6/1986 | Matsui | 57/304 |
| 4,617,792 | 10/1986 | Stahlecker | 57/304 X |
| 4,825,634 | 5/1989 | Halder et al. | 57/305 |
| 4,936,086 | 6/1990 | Carter et al. | 57/304 |
| 5,029,360 | 7/1991 | Straub et al. | 15/312.2 X |

*Primary Examiner*—Joseph J. Hail, III

*Attorney, Agent, or Firm*—W. Thad Adams, III

[57] ABSTRACT

A pneumatic cleaner for textile machinery adapted to travel along the length of endwise-aligned machines in which yarn spindles have whirl-cleaner blades to strip the turns of yarn from the whirl. The cleaner has exhaust tubes having at least one exhaust port for blowing cleaning air into the machinery. One of the exhaust tubes has a retractable and extendible nozzle to direct the cleaning air against each whirl-cleaner blade and to displace said blade end into engagement with the whirl of each spindle as the cleaner passes the spindle. The nozzle is extended into close proximity to each whirl-cleaner blade by the flow of cleaning air and is retracted from said whirl-cleaner blade when flow of cleaning air is stopped. The flow of cleaning air is controlled with the travel of the cleaner, so that the nozzle is retracted to avoid interfering with other parts of the machinery when it is not needed to actuate the blades.

10 Claims, 4 Drawing Sheets

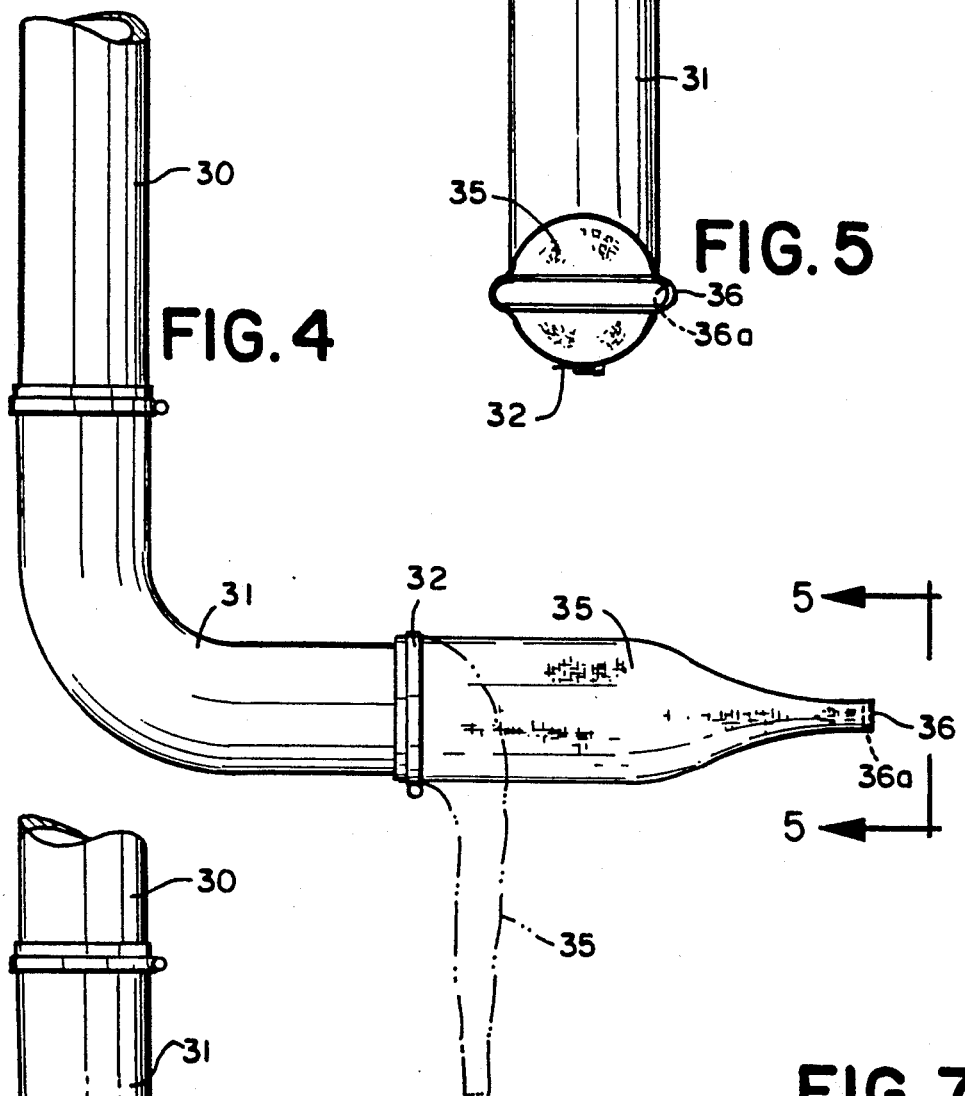
FIG. 5
FIG. 4
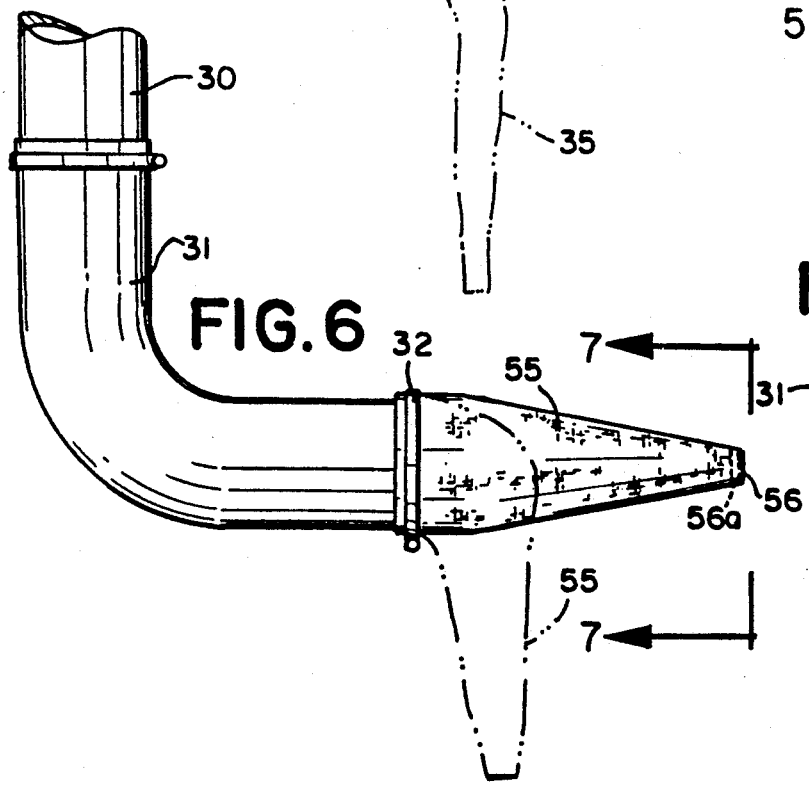
FIG. 6
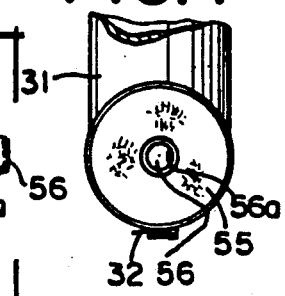
FIG. 7

FLEXIBLE WHIRL-CLEANING NOZZLE

FIELD OF THE INVENTION

The present invention relates to a flexible nozzle for use in a textile machine cleaning device adapted to traverse the length of a textile machine having a series of yarn-handling stations.

BACKGROUND OF THE INVENTION

In a ring-spinning frame, yarn from packages of roving passes through drafting rolls and yarn guides to a traveler ring which orbits the bobbin and traverses the length of the bobbin, building a compact package of spun yarn on the bobbin. The area of the spindle below which the bobbin sits is referred to as the whirl. Several wraps of yarn are wound onto the whirl during each doff cycle.

During the spinning cycle, yarn is wound onto the empty bobbins. Once the bobbins are full, the ring rail traverses down below the bobbin and several wraps of yarn are wound onto the whirl before the spinning frame is stopped to doff the full bobbins. After the full bobbins are removed from the spindle and the frame is restarted, several wraps of yarn remain on the whirls.

It is important that the yarn remaining on the whirls be removed regularly to avoid excess buildup on the whirls and eventful discharge of yarn and fiber into the rings, travelers, or yarn being processed. To facilitate regular and efficient removal of the excess yarn, many methods using brushes, various materials and rotating disks have been used to tear or scrape away the excess yarn from the whirl. The most recent of these methods is disclosed in U.S. Pat. No. 4,936,086 in which blade-like devices are mounted adjacent to the base of each spindle. These blades have a flat target area such that a stream of compressed air directed against the blade causes the end edges of the blade to move against the spindle whirl. The excess yarn on the whirl is impinged by the blades, broken, and thrown off the whirl.

The pressure of the compressed air may be reduced when the nozzle of the compressed air source is placed in close proximity to the whirl cleaner blades. This distance, however, is limited by the maximum width of the textile machine or any other obstructions the cleaning machine must negotiate while traversing one or several textile machines.

Whirl cleaning is normally only one function of a textile-cleaning machine. A typical cleaner continuously traverses the textile machine blowing lint and fly from the machines and collecting from the floor loose fibers and other particulate matter created in the spinning process. The whirl-cleaning function is required for only a fraction of this time; thus, the controls described in the above-noted patent interrupt the discharge of compressed air, impinging the whirl blades when whirl cleaning is not required.

SUMMARY OF THE INVENTION

The present invention provides a more efficient alternative textile machine cleaning device capable of efficiently cleaning excess yarn from spindle whirls. The invention is particularly adaptive to cleaning arrangements for several textile machines or for textile machines with obstructions along the traverse path of the cleaning device.

More specifically, the present invention provides a more efficient self-propelled textile machine cleaning device designed to travel along the length of a textile machine on an overhead track. A self-propelled cleaner carriage traverses the textile machine guided along an overhead track, and comprises a drive means, suction and exhaust means to generate an outward flow of cleaning air and an inward flow of vacuum air, and suction and exhaust tubes, and suction and exhaust ports on said tubes, and without a separate supply of compressed air and the controls therefor.

To eliminate the need for a separate supply of compressed air, one of the exhaust tubes (hereinafter actuation tube) is designated primarily for the whirl-cleaning function. Exhaust air is directed through the actuation tube at discrete times. The actuation tube has only one exhaust port which sequentially engages movable whirl-cleaner blades located below each spindle and an extendible nozzle is positioned to direct a stream of air against the cleaner blades. The cleaner blades impinge on the excess yarn wrapped around the whirl and scrape the whirl clean. The suction ports of the suction tubes collect the stripped yarn as well as other dirt and particulate matter created during the spinning cycle.

A flexible extendible and retractable nozzle (hereinafter actuation nozzle) is fixed to the port on the actuation tube. The actuation nozzle is made of a lightweight, flexible material such that upon activation of the actuation tube, the actuation nozzle is extended to its maximum length and optimal position in close proximity to the whirl-cleaner blades. Upon deactivation of the actuation tube, the actuation nozzle retracts away from the whirl-cleaner blades, allowing the carriage to pass unobstructed past the head and foot ends of the textile machine or any other obstruction along the tracks of the carriage path. A control means within the carriage controls exhaust airflow through the actuation tube.

In its extended position, the actuation nozzle comes into much closer proximity to the whirl-cleaner blades than conventional rigid nozzles. This obviates the need for a compressed air source if the same low pressure air used for cleaning is diverted through the actuation tube. The nozzle concentrates and sufficiently accelerates the low pressure exhaust from the blower to effectively activate the whirl-cleaner blades, avoiding the need for using compressed air. The actuation nozzle may, however, also be used in a system utilizing a separate source of compressed air to activate the actuation nozzle.

BRIEF DESCRIPTION OF THE DRAWINGS

All of the objects of the invention are more fully set forth hereinafter with reference to the accompanying drawings, wherein:

FIG. 4 is a side view of the nozzle in extended position, showing the retracted position in broken lines;

FIG. 5 is a front view taken along the line 5—5 of FIG. 4;

FIG. 6 is a view similar to FIG. 4 showing an alternative embodiment of the nozzle in extended position in full lines and in retracted position in broken lines; and FIG. 7 is a front view taken along the line 7—7 of FIG. 6.

DESCRIPTION OF THE PREFERRED EMBODIMENTS

Figure 1:
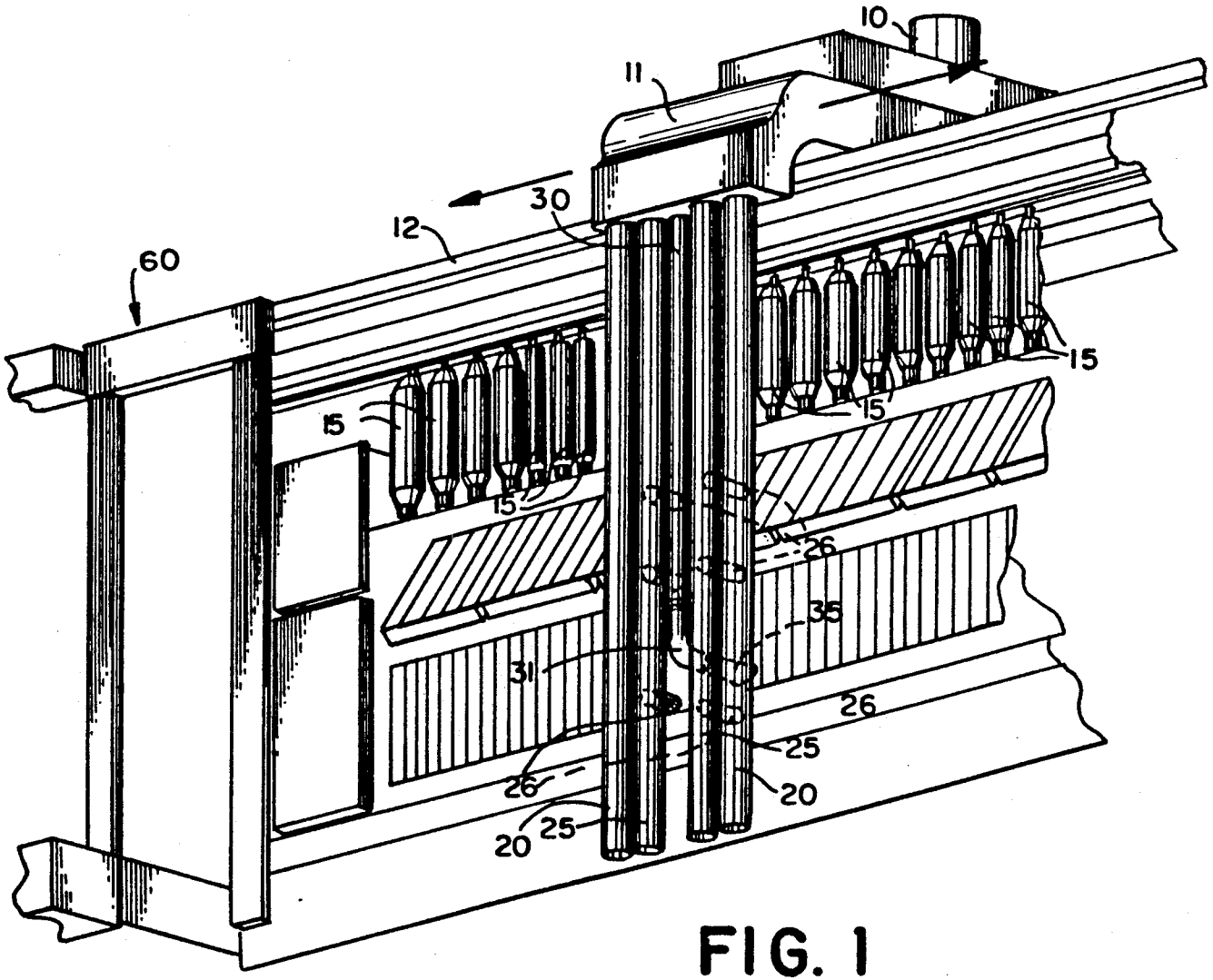
FIG. 1 is a diagrammatic perspective view of a pneumatic cleaner embodying the invention traversing a textile machine.
Figure 2:
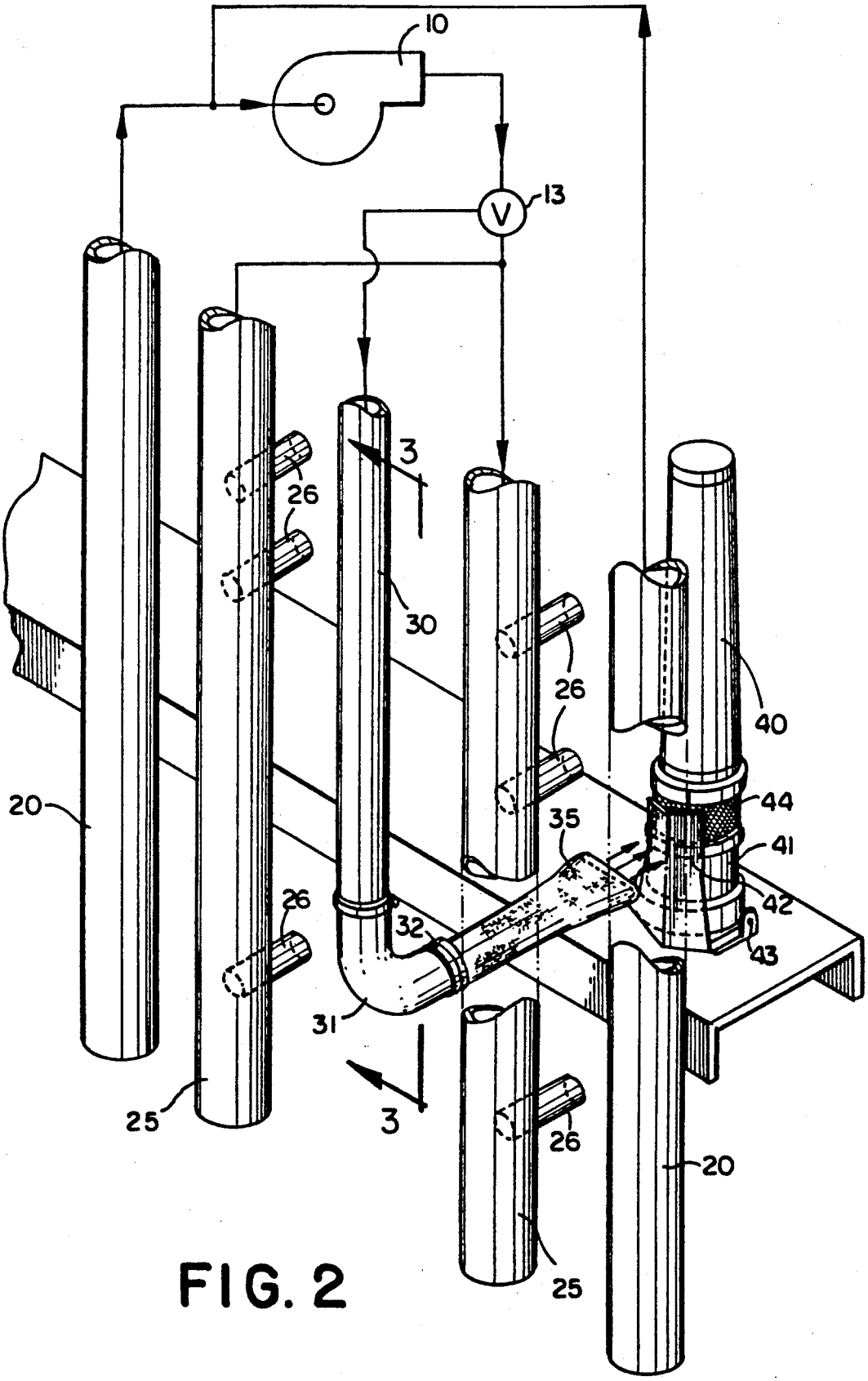
FIG. 2 is an exploded fragmentary perspective view of the nozzle in extended position and acting on a whirl-cleaner blade.

Referring now in greater detail to the drawings, the invention is applicable to a textile machine having a series of yarn-handling stations. FIGS. 1 and 2 show a cleaning device supported by a carriage 11 which is self-propelled by a drive means and traverses the textile machine on a pair of tracks 12 along the top of the textile machine. The carriage also carries a blower and suction device 10 which produces an outward flow of cleaning air through exhaust tubes 25,25 and an inward flow of suction air through vacuum tubes 20,20. The exhaust and suction tubes direct the cleaning air and vacuum air to and from those areas of the machine where fibers and other particulate matter accumulate. Numerous nozzles are in communication with said exhaust ports and arranged in conformity with the design of the textile machine to help cleaning. The nozzles vary in number and are oriented in various directions to accommodate any particular machine. The spacing between the tubes is not critical nor is the number of exhaust tubes 25 and suction tubes 20 arranged in the array.

Figure 3:
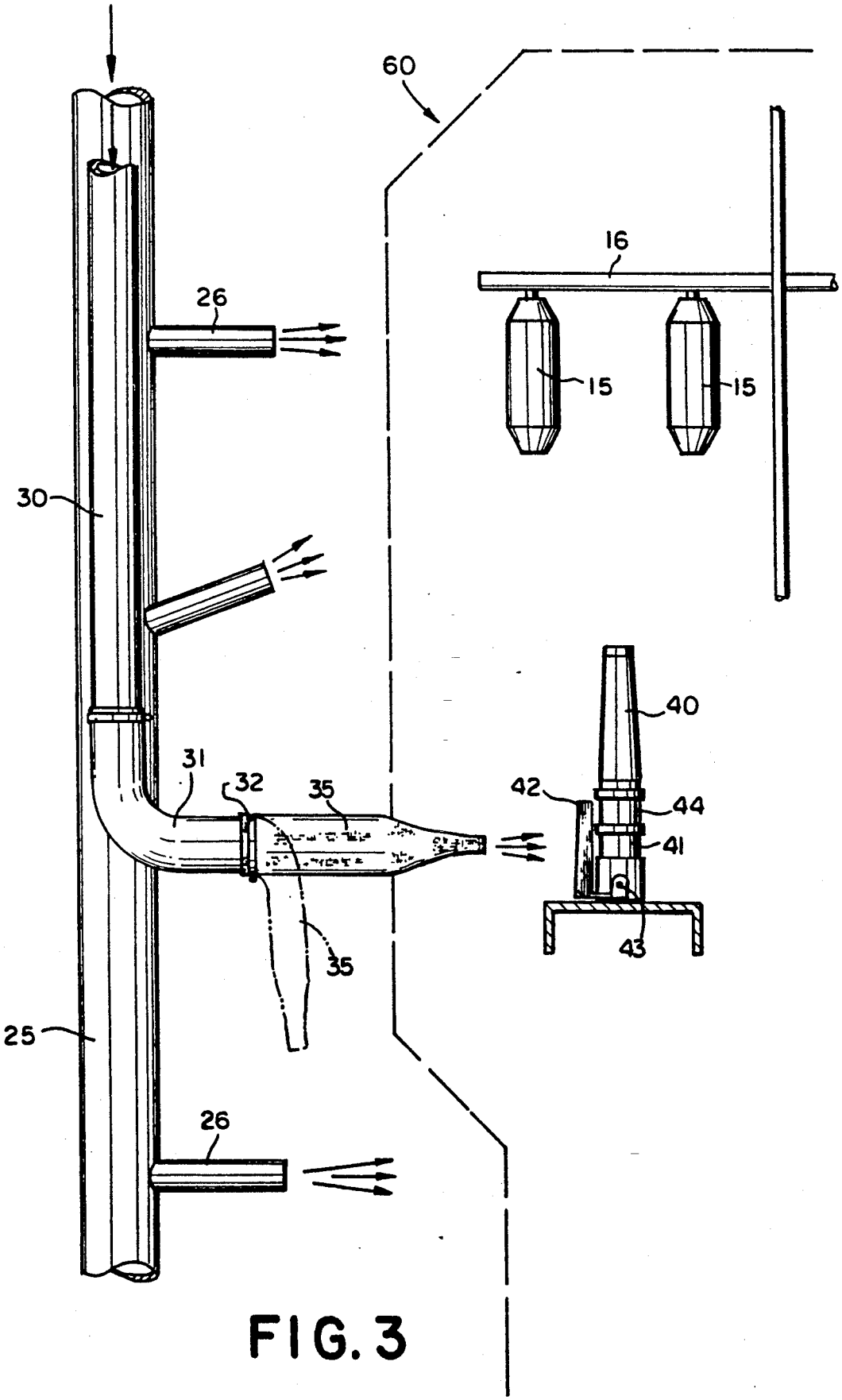
FIG. 3 is a cross-sectional view taken along the line 3—3 of FIG. 2 showing the extended nozzle acting on a whirl-cleaner blade.

Referring to FIG. 3, a typical yarn-handling station of a ring-spinning frame, with which a preferred embodiment of this invention interacts, is shown in which there is a creel 16 for supporting a plurality of packages of roving 15. The roving from the packages 15 is passed through appropriate yarn-handling devices (not shown) and finally through a traveler (not shown) on a spinner ring mounted for orbiting around a bobbin 40 mounted on a spindle 41. The spinner ring traverses the length of the bobbin winding the yarn onto the bobbin 40.

At the end of the spinning cycle, several wraps of yarn are wound onto the area just below the bobbin, referred to as the whirl 44. Unless the excess yarn is removed after each doff, the yarn will build up on the whirl 44, and pieces of yarn and fiber may be thrown off the whirl and may contaminate the ring travelers, or yarn being processed. This can result in yarn inferiority or yarn breakage. Thus, it is advantageous to remove the excess yarn regularly.

In order to remove the turns of yarn accumulated on the whirls during the doff, and referring to FIG. 2, blade-like devices 42 are pivotally mounted adjacent the base of each spindle 41. Each blade has a flat target area such that a jet of air directed at right angles to the blade causes the blade to rotate about its pivot mounting 43 and come into contact with the whirl 44. The excess yarn on the whirl is impinged by the blade which then scrapes or tears the whirl clean as the spindle 41 rotates. The excess yarn is thrown off and removed by the vacuum tubes 20,20.

A retractable and extendible nozzle 35 (hereinafter referred to as "actuation nozzle") is in communication with the exhaust port for directing the actuation air into contact with said blades 42. The retractable and extendible nozzle enable the use of actuating air at a much lower pressure than is required by the arrangement shown in U.S. Pat. No. 4,936,086 and provides an improvement in cleaning efficiency over the prior art. In one embodiment of the current invention, the cleaner blades 42 are actuated by the same low pressure, exhaust air used for cleaning. In another embodiment of the current invention (not shown), a separate supply of compressed air can be used to actuate the whirl-cleaner blades. In either case, the air to actuate the cleaner blades 42 is provided through a separate exhaust tube 30 (hereinafter referred to as "actuation tube") having one exhaust port.

As seen in FIGS. 1 and 2, the actuation tube 30 is shown suspended from the carriage 11, and is disposed to discharge a jet of air against the cleaner blade at a sufficient height above the pivots 43 to displace the free end of the blade 42 into engagement with the whirl 44. Referring to FIG. 3, the actuation tube 30 is shown approximately $\frac{2}{3}$ the diameter of one of the cleaning exhaust tubes 25,25. The actuation tube 30 is suspended at its source end from the carriage 11 which also contains a control valve 13 shown schematically in FIG. 2 regulating the flow of air through the actuation tube 30 since the whirl-cleaning function is only necessary for a short period of time during the spinning cycle. At its discharge end, a 90° elbow 31 is in communication with the actuation tube 30, and is secured to the lower end of the tube. Actuation nozzle 35 is in communication with the elbow 31 at its discharge end and is secured to the elbow 31 by a clamping mechanism 32 or similar means. Other rigid cleaning nozzles 26 are shown in communication with exhaust tubes 25. The cleaning nozzles 26 vary in number and direction depending on the profile and arrangement of the components of the textile machine.

During the whirl-cleaning cycle, the cleaning machine normally will make several passes past the whirl 44 since the impinging force created by the blade 42 on the excess yarn may be insufficient to scrape the whirl 44 clean on one pass of the cleaning machine.

To maximize efficiency, it is desirable to locate the distal discharge end of the actuation nozzle 35 as close to the cleaner blade 42 as possible, thereby increasing the impinging force exerted on the excess yarn by the blade. With a conventional rigid nozzle, its proximity to the blade 42 is restricted by the extension of the foot and head ends of the textile machine or any other obstruction the cleaning device must pass while traversing the length of one machine or while traveling to another machine. For example, referring to FIG. 3, dotted line 60 represents the extension of the head or foot ends of the textile machine away from the centerline of the machine. If a conventional, rigid actuation nozzle were utilized, the distal discharge end should be either inefficiently located far enough away from the blades to avoid interference with the head or foot ends 60, or efficiently located in close proximity to said blades 42 but would need to be displaced out of the path of the ends when the cleaning machine traverses the length of a textile machine past the ends. As illustrated in FIGS. 3 and 4, the novel extendible and retractable actuation nozzle obviates both of these problems. In its extended position, the actuation nozzle 35 is in very close proximity to the cleaner blade 42, increasing the efficiency of the cleaner. In its retracted position, the actuation nozzle 35 is withdrawn from the vicinity of the cleaner blades and is positioned adjacent the elbow 31 so as not to interfere with the travel of the cleaning machine past the ends of the textile machine.

FIG. 4 shows one preferred embodiment of the present invention in which the activation nozzle 35 is made of a lightweight flexible material which is substantially impervious to air. The actuation nozzle 35 has a restricted mouth 36 which accelerates and concentrates the same low pressure exhaust air used for cleaning. The nozzle 35 is circular in shape at its proximal end which conforms to the shape of the elbow 31 and is connected at 32 for airtight communication. The nozzle 35 has a slot-like mouth 36 at its distal end, which is elongated in the direction of travel of the cleaner, so as to provide a prolonged period of air impingement against the target area of the blade 42. The shape of the distal end shown in FIG. 5 is retained by a rigid ring structure 36*a* sewn into the end material of the nozzle. The ring structure 36*a* may be made of plastic or metal and may either be completely rigid or malleable to form other shapes.

In the embodiment shown in FIGS. 2–5, the nozzle is made from a cylindrical tube of soft, lightweight, and flexible fabric which is substantially impermeable to air. The proximal end fits over the face end of the elbow 31, and the distal end is fitted with the ring structure 36*a* to form a slot-like mouth 36. The mouth provides a flow area at the distal end of the nozzle which is less than approximately 20% of the flow area at the proximal end, so as to concentrate and accelerate the airflow discharged from the mouth 36.

The weight of the ring 36*a* and flexibility of the material are such that the nozzle is completely or partially retracted or collapsed when there is no supply of actuation exhaust air, and the nozzle is extended or inflated upon activation of the actuation air. The release of air through the actuation tube 30 is controlled by the control valve 13. Actuation air is diverted through the actuation tube only during the whirl-cleaning cycle and only while the cleaning machine is traversing the spinning frame section of the textile machine. The valve 13 preferably interrupts the flow of actuation air through the tube 30 when the cleaner passes the end structures 60. When servicing several textile machines having a common track means extending along the combined length of the machines, each machine controls the valve 13 as the carriage approaches it, and the valve 13 interrupts flow through the tube 30 when the carriage is traveling between adjoining machines.

FIGS. 6 and 7 show another embodiment of the present invention. In FIGS. 6 and 7, the nozzle is made of a material with similar weight and rigidity properties as described immediately above, but has a different shape. FIGS. 6 and 7 show an actuation nozzle 55 with an overall conical shape in communication with the 90° elbow 31. In the embodiment shown in FIGS. 6 and 7, the nozzle 55 is also made from a soft, lightweight, and flexible material which is substantially impermeable to air but has a conical shape. The proximal end fits over the face end of the elbow 31, and the distal end is fitted with the ring structure 56*a* to form a circular mouth 56 which has a smaller flow area smaller than the flow area at the proximal end. In the present instance, the flow area of the mouth 56 is substantially less than 20% of the flow area of the elbow so as to accelerate and concentrate the airflow discharged from the mouth 36.

The nozzle's smaller cross-sectional area at the discharge end 56 causes the low pressure exhaust air to be concentrated and accelerated before impinging upon the cleaner blade 42. The distal circular end shape is retained by a rigid circular structure 56*a* sewn into the end of the nozzle. The rigid structure 56*a* may be completely rigid or malleable to form other shapes.

As will become apparent hereinafter, the retractable and extendible nozzle is not limited in use to the specific whirl-cleaner device mentioned above. In either of the aforementioned embodiments, the present invention is not limited to the use of the same low pressure exhaust air used for cleaning. The present invention is also useful in cleaning machines using a separate source of high pressure air. In such a case, the actuation nozzle need not serve the purpose of accelerating and concentrating the actuation air but may serve simply to improve the efficiency of the cleaning machine. Using conventional rigid actuation nozzles and a separate compressed air source, the cleaning machine still must make multiple passes over a whirl to effectuate complete removal of the excess yarn. By locating the distal discharge end of the actuation nozzle in close proximity to the cleaner blade without causing it to interfere with the traverse of the cleaning machine, the impinging force on the cleaner blade will be increased and will increase cleaning efficiency. Using a separate source of compressed air which is activated instead of using the the valve 13, also has the advantage of not diverting the flow of cleaning air during the whirl-cleaning cycle. Furthermore, the control valve 13 is designed to divert cleaning air from the blower tubes 25 to serve as actuation airflow during the whirl-cleaning cycle and only when the cleaning machine is traversing the spinning frame section of the textile machine, and to arrest the actuating airflow when the cleaning machine passes the ends of the textile machine. If desired, the valve 13 may be designed to divert only a portion of the cleaning air.

From the foregoing description, it should also be appreciated that the actuation nozzle in either of the aforementioned embodiments does not require any type of control system to trigger its extension or retraction. It is automatically erxtended when air is directed into the actuation tube and automatically retracted when the air supply is discontinued. Nor does the actuation nozzle require any positioning control system. Upon extension, the nozzle is automatically drawn back into close proximity to the actuation tube 30 upon retraction.

While considerable emphasis has been placed herein on the expandible and retractable nozzle as an inflatable-type nozzle, it should be appreciated that the desired operation of the nozzle can be achieved with other types of nozzles, and is not limited to an inflatable-type nozzle made of a lightweight flexible material. For example, other types of extendible and retractable nozzles include a telescopic-type nozzle which extends and retracts in discrete steps.

Nor is the present invention's intended use limited to textile machines which utilize air to actuate whirl-cleaner blades. The present invention has applications in a more general setting than mentioned above. For example, operation of the spinning frame also produces a substantial quantity of lint, dust and other particulate matter which is airborne and deposited on mechanisms in the machine. As shown in FIG. 3, a series of rigid exhaust nozzles 26 for directing cleaning air to specified portions of the textile machine protrude from the exhaust tube 25. It is within the scope of this invention to substitute expandible and retractable nozzles as described above for the rigid exhaust nozzles 26 to supply cleaning air closer to the machine parts where needed. The expandible and retractable nozzles are in closer proximity to the textile machine, thereby more efficiently removing the particulate matter from around the vicinity of the spinning frame.

While particular embodiments of the present invention have been herein illustrated and described, it is not intended to limit the invention to such disclosures but changes and modifications may be made therein and thereto within the scope of the following claims.

We claim:

1. In a textile machine cleaning device adapted to travel along the length of at least one textile machine having a series of yarn-handling stations which require a flow of cleaning air: said cleaning device comprising:

(a) track means extending along the entire length of said textile machine, (b) a carriage mounted on said track means for travel along the length of said machine, and having suction and exhaust means to generate an outward flow of cleaning air and an inward flow of vacuum air, (c) an exhaust tube connected to said exhaust means and having at least one exhaust port, and a suction tube connected to said suction means and having at least one suction port, (d) the improvement wherein said exhaust tube includes a retractable and extendible nozzle having a proximal end supported in communication with said exhaust port for travel along the length of the textile machine, and a distal end opening positioned when the nozzle is extended into close proximity to said textile machine to direct said cleaning air toward the yarn-handling stations, and positioning away from the textile machine when the nozzle is retracted, said nozzle comprising a soft and lightweight flexible inflatable material with a distal cross-sectional flow area and a proximal cross-sectional flow area, said distal cross-sectional flow area being less than said proximal cross-sectional flow area, for concentrating and accelerating said outward flow of cleaning air;

(e) control means operable to control the flow of cleaning air from said exhaust means to alternatively extend and retract said nozzle by the flow of cleaning air and by the absence of flow of cleaning air respectively.

2. A cleaning device according to claim 1 wherein the distal end of said nozzle is constructed and arranged to be extended into close proximity to said textile machine by the flow of cleaning air and retracted from said textile machine by the absence of flow of cleaning air, said control means being operable to control the flow of cleaning air.

3. A cleaning device according to claim 1 wherein said control means operates in response to travel of said carriage to automatically extend the distal end of said nozzle into close proximity to said textile machine only while said cleaning device is traversing past said stations of the textile machine requiring a flow of cleaning air.

4. A cleaning device according to claim 1 wherein said control means operates in response to travel of said carriage to automatically retract the distal end of said nozzle in close proximity to the proximal end thereof allowing unimpeded passage of said cleaning device past the ends of said textile machine after said cleaning device has traversed past said yarn-handling stations of the textile machine requiring a flow of cleaning air.

5. A cleaning device according to claim 1 wherein said distal opening is elongated in the direction of travel of the cleaning device.

6. In a textile machine cleaning device adapted to travel along the length of at least one textile machine having a series of yarn-handling stations which require a flow of cleaning air: said cleaning device comprising:

(a) track means extending along the entire length of said textile machine, (b) a carriage mounted on said track means for travel along the length of said machine, and having suction and exhaust means to generate an outward flow of cleaning air and an inward flow of vacuum air, (c) an exhaust tube connected to said exhaust means and having at least one exhaust port, and a suction tube connected to said suction means and having at least one suction port, (d) the improvement wherein said exhaust tube includes a retractable and extendible nozzle having a proximal end supported in communication with said exhaust port for travel along the length of the textile machine, and a distal end positioned when the nozzle is extended into close proximity to said textile machine to direct said cleaning air toward the yarn-handling stations, and positioning away from the textile machine when the nozzle is retracted, wherein said nozzle is conical-shaped and comprises a soft, lightweight, and flexible fabric substantially impermeable to air, said distal end fitted with a ring structure sewn into the fabric of said distal end, said ring structure forming a circular distal opening; and (e) control means operable to control the flow of cleaning air from said exhaust means to alternatively extend and retract said nozzle by the flow of cleaning air and by the absence of flow of cleaning air respectively.

7. A cleaning apparatus for cleaning operating parts of a textile machine, comprising:

(a) a conveyor extending along the length of the textile machine;

(b) a carriage for moving on the conveyor along the length of the textile machine;

(c) a blower mounted on the carriage for supplying cleaning air under pressure, and including control means for alternately supplying air from the blower and shutting off the supply of air from the blower;

(d) a nozzle cooperating with the blower for delivering pressurized cleaning air from the blower to the operating parts of the textile machine, the nozzle alternately moveable between an inoperative, retracted, non-cleaning position, and an operative extended, cleaning position;

(e) the nozzle including biasing means for normally biasing the nozzle in the inoperative, retracted, non-cleaning position when the supply of pressurized air from the blower is shut off by the control means; and (f) the nozzle responsive to dynamic pressure of a supply of pressurized cleaning air from the blower to overcome the biasing means and to extend the nozzle into an operative position in closely spaced-apart relation to the operating parts of the textile machine to be cleaned, wherein said textile machine comprises a machine for winding yarn onto a spindle-mounted bobbin at each of a plurality of yarn-handling stations during a winding cycle, said spindle including a whirl having a circumferential surface adjacent one end of the bobbin for receiving several wraps of yarn at the conclusion of the winding cycle, and the operating parts of the textile machine to be cleaned by the pressurized air through the nozzle comprise a whirl-cleaner blade positioned adjacent each yarn-handing station for engaging and thereby stripping yarn from the whirl-cleaner blade.

8. A cleaning apparatus according to claim 7, wherein said biasing means comprises a flexible hose moved by its own weight into the inoperative, retracted, non-cleaning position when pressurized air from the blower is shut off and the flexible hose is deflated, and inflatable into the extended operative position by dynamic air pressure.

9. A cleaning apparatus according to claim 8, wherein said flexible hose has a narrowed opening of reduced area for concentrating and accelerating the flow of cleaning air.

10. A cleaning apparatus according to claim 9, wherein said flexible hose comprises a soft, lightweight fabric substantially impermeable to air.

* * * * *